US012655837B2

(12) United States Patent
France et al.

(10) Patent No.: US 12,655,837 B2
(45) Date of Patent: Jun. 16, 2026

(54) APPARATUS FOR PERISTALTICALLY PUMPING LIQUID ONTO A ROTATING SURFACE

(71) Applicant: Samsung Electronics Co., Ltd., Suwon-si (KR)

(72) Inventors: Ivan France, Saratoga, CA (US); Forrest Tran, Milpitas, CA (US); Eunseo Cho, Mountain View, CA (US); Ziwen Jiang, Sunnyvale, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 286 days.

(21) Appl. No.: 18/381,802

(22) Filed: Oct. 19, 2023

(65) Prior Publication Data

US 2025/0127365 A1 Apr. 24, 2025

(51) Int. Cl.
*F04B 43/12* (2006.01)
*A47L 11/40* (2006.01)

(52) U.S. Cl.
CPC ..... *F04B 43/1269* (2013.01); *A47L 11/4083* (2013.01); *A47L 11/4088* (2013.01); *F04B 43/1292* (2013.01)

(58) Field of Classification Search
CPC ..... A47L 11/4088; A47L 11/4038; A47L 11/4083; F04B 43/1292; F04B 43/1269
See application file for complete search history.

(56) References Cited

U.S. PATENT DOCUMENTS 4,664,565 A * 5/1987 Palm ..... B23Q 11/1092 408/710
5,657,503 A * 8/1997 Caruso ..... A47L 11/4069 15/97.1
8,167,510 B2 5/2012 LaFlamme
10,138,881 B2 11/2018 Centofante
10,786,133 B2 9/2020 Jang
(Continued)

FOREIGN PATENT DOCUMENTS

CN 109552443 4/2019
CN 213910058 8/2021
(Continued)

OTHER PUBLICATIONS

International Search Report in International Application No. PCT/IB2024/060064, Feb. 7, 2025.
(Continued)

*Primary Examiner* — Nathan C Zollinger

(57) ABSTRACT

In one embodiment, an apparatus includes an actuator coupled to an end effector, the actuator configured to create relative rotation between the actuator and the end effector. The apparatus further includes one or more peristaltic-pump rollers coupled to the actuator. The end effector includes a liquid-storage chamber configured to store a liquid and a flexible tubing that includes: (1) an intake disposed within the liquid-storage chamber, (2) an outlet configured to dispense the liquid onto an outer surface of the end effector, and (3) a peristaltic section configured to compress against at least one of the one or more peristaltic-pump rollers as a result of the relative rotation between the actuator and the end effector.

20 Claims, 4 Drawing Sheets

(56) References Cited

U.S. PATENT DOCUMENTS

| | | | | |
|---|---|---|---|---|
| 11,219,347 | B2 | 1/2022 | Johnson | |
| 11,407,632 | B2 | 8/2022 | Mazzola | |
| 11,607,715 | B2 | 3/2023 | Terry | |
| 2009/0271940 | A1 | 11/2009 | Lee | |
| 2014/0154118 | A1* | 6/2014 | Hendrickson | F04B 43/09 417/474 |
| 2014/0271293 | A1* | 9/2014 | Gledhill, III | F04B 43/08 29/525.08 |
| 2015/0122835 | A1* | 5/2015 | Gonzalez | B65D 21/083 222/105 |
| 2016/0294306 | A1* | 10/2016 | Kobayashi | H10N 30/704 |
| 2018/0071907 | A1* | 3/2018 | Myhill | B25F 5/00 |
| 2021/0038045 | A1 | 2/2021 | Lim | |
| 2022/0127982 | A1* | 4/2022 | O'Callaghan | F16N 29/00 |
| 2022/0178362 | A1 | 6/2022 | Leigh | |
| 2023/0111199 | A1 | 4/2023 | Chang | |
| 2025/0215871 | A1* | 7/2025 | Strange | F04B 43/082 |

FOREIGN PATENT DOCUMENTS

| | | |
|---|---|---|
| CN | 218009557 | 12/2022 |
| DE | 2 373 590 T3 | 2/2012 |
| EP | 2 170 146 B1 | 7/2013 |
| WO | WO 2023-046282 A1 | 3/2023 |

OTHER PUBLICATIONS

Written Opinion in International Application No. PCT/IB2024/060064, Feb. 7, 2025.

Samsung JetBot Mop (https://www.samsung.com/us/home-appliances/vacuums/jetbot-mop/jetbot-mop-with-dual-spinning-technology-in-white-vr20t6001mw-aa/), Accessed on Sep. 6, 2023.

Extended European Search Report in Application No. 24879246.7-1009 / 4739184 PCT/IB2024/060064, Apr. 19, 2026.

* cited by examiner

APPARATUS FOR PERISTALTICALLY PUMPING LIQUID ONTO A ROTATING SURFACE

TECHNICAL FIELD

This application generally relates to an apparatus for pumping liquid onto a rotating surface.

BACKGROUND

In a typical peristaltic pump, a motor rotates a set of rollers across a flexible tube containing a fluid. The rollers trap liquid in the tube by pinching off sections of tubing where the roller and tube meet. The roller then pushes trapped liquid through the tube until the liquid reaches an outlet. A peristaltic pump provides a metered flow rate and is commonly used to create slow and controlled flow rates without interacting directly with the liquid. For example, in medical applications, the liquid can be pumped without the possibility of being contaminated by contact with pumping elements.

A check valve allows fluid to flow in only one direction. Examples of check valves include a swing or hinged-type check valve and a ball-and-set check valve, among others.

DESCRIPTION OF EXAMPLE EMBODIMENTS

Figure 1:
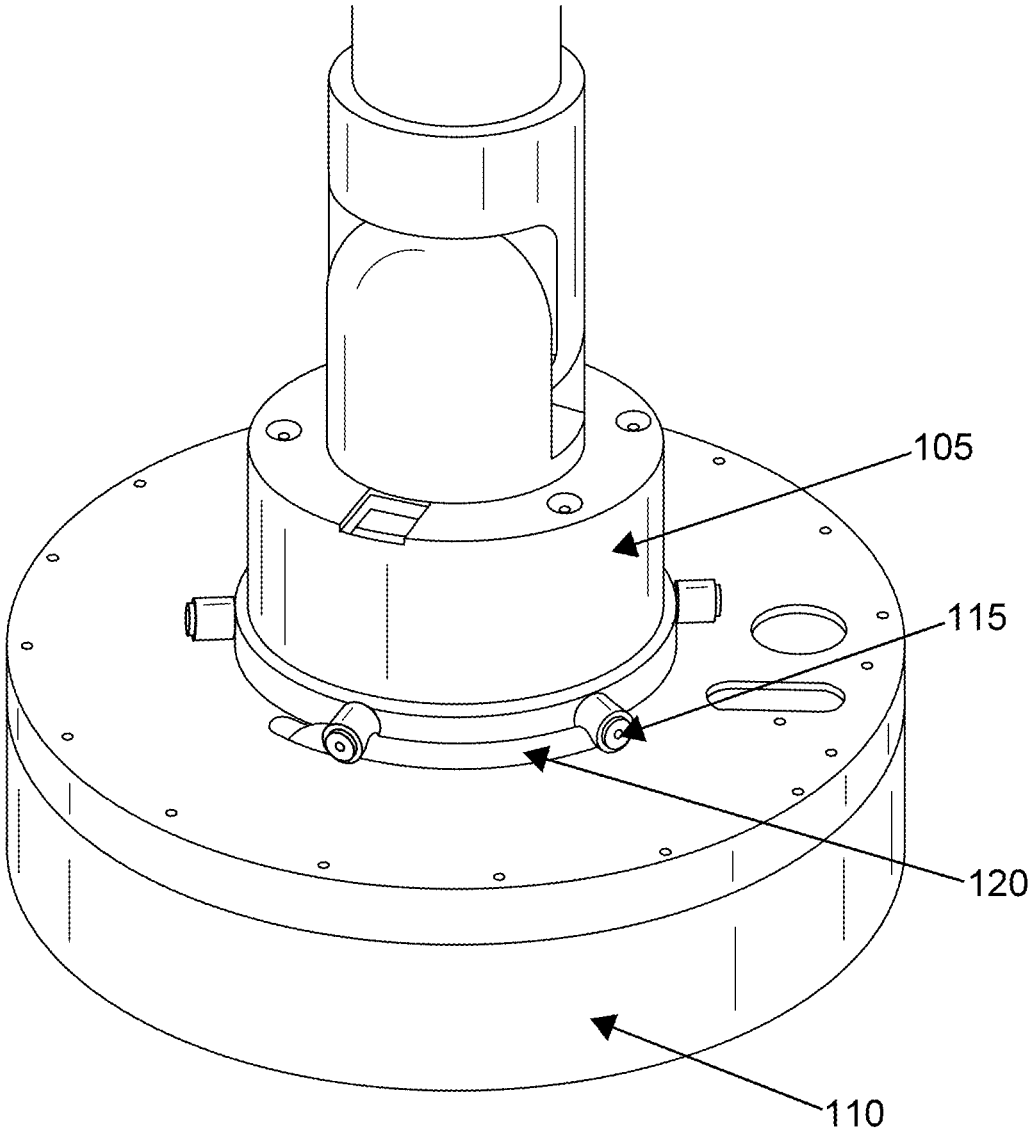
FIG. 1 illustrates an example apparatus for pumping liquid onto a rotating surface.

FIG. 1 illustrates an example apparatus for pumping liquid onto a rotating surface. The apparatus includes an actuator 105 (e.g., a motor) that generates relative rotation between actuator 105 and an end effector 110. For example, the actuator may rotate end effector 110 while actuator 105 remains fixed, or may rotate actuator 105 while end effector 110 remains fixed. Attached to actuator 105 are one or more rollers 115. Due to the relative rotational motion of actuator 105 and end effector 110, rollers 115 periodically compress a portion of flexible pump tube 120, which pumps liquid through the tube. As illustrated in FIG. 1, flexible pump tube 120 is part of (i.e., moves with) end effector 110, while rollers 115 are part of (i.e., move with) actuator 105.

Figure 2:
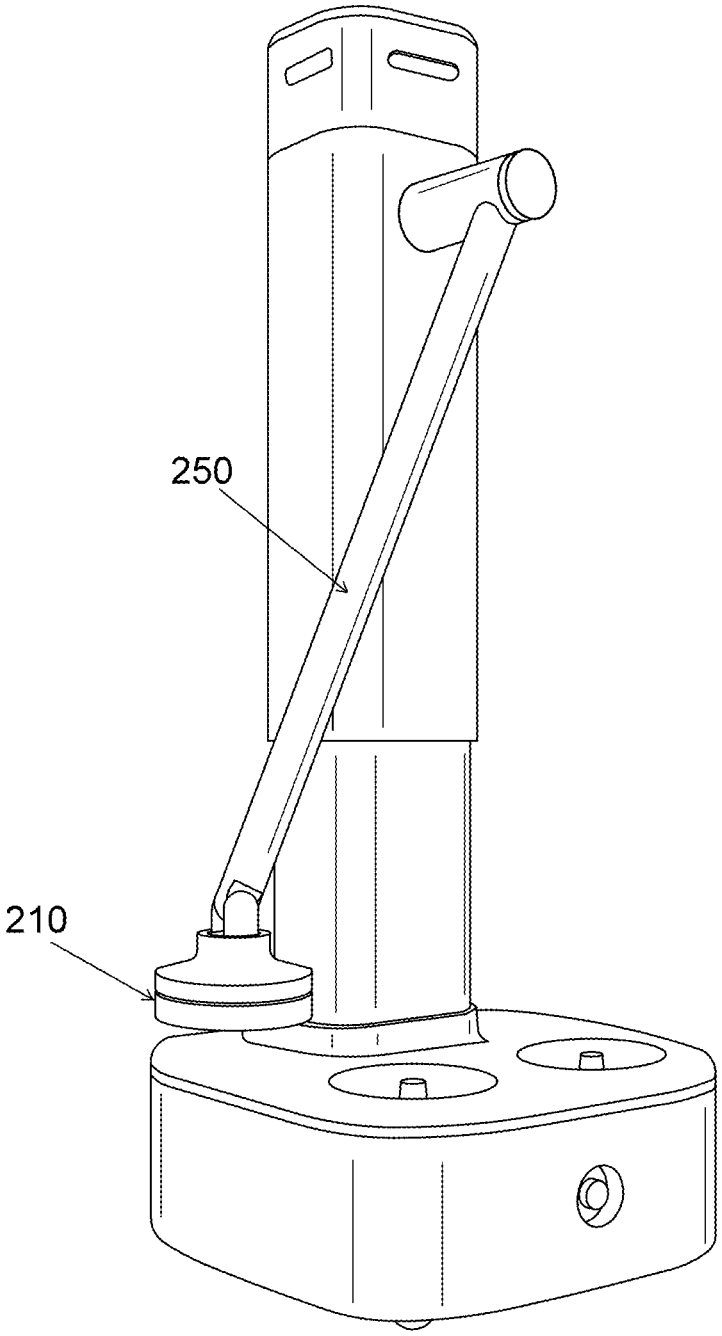
FIG. 2 illustrates an example of a robot with an end effector that can be used to automatically clean various surfaces.

In the example of FIG. 1, end effector 110 is the terminal component of a robotic arm. For example, end effector 110 may include a foam material covered by a cloth pad. The cloth pad may be used for cleaning surfaces, e.g., wiping, dusting, mopping, etc. For example, circular motion of the end effector may be used to clean a surface contacted by the cloth pad, and the pumping action described herein may be used to accurately and consistently pump cleaning liquid onto the pad, as described more fully herein. FIG. 2 illustrates an example of a robot having an end effector 210 at the end of a robotic arm 250, which can be used to automatically clean various surfaces, including surfaces that are above ground level. While the example of FIG. 1 illustrates a pumping apparatus in the context of a robotic system, this disclosure contemplates that the pumping apparatus may be used in any suitable system, and the end effector may be any suitable terminal piece of the system. For example, the end effector may be a rotating pad of a sander, of a polishing device, or of a cutting device, and the pumped liquid may be, e.g., lubricant, polish, etc., as appropriate for the end effector in that specific system.

Figure 3:
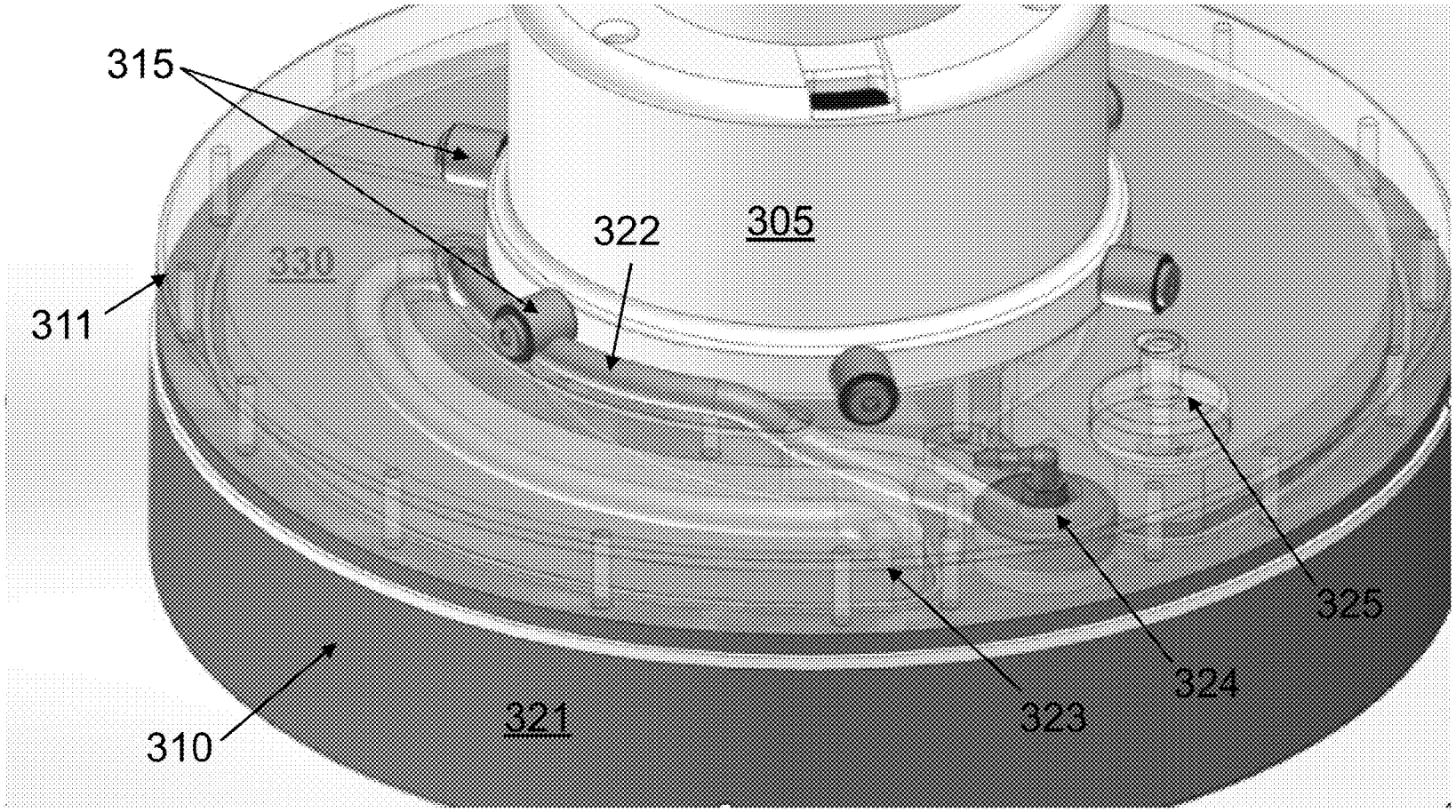
FIG. 3 illustrates a partial interior view of the example apparatus of FIG. 1.

FIG. 3 illustrates a partial interior view of the example apparatus of FIG. 1. In FIG. 3, certain internal components of end effector 310 are shown. In FIG. 3, upper portion 311 of end effector 310 is shown as partially transparent, revealing certain internal components of end effector 310. The internal components include liquid-storage chamber 330, which holds the liquid in the interior of end effector 310. Intake 323 of a line of flexible tubing, which is part of the end effector, draws liquid into the tubing from the liquid-storage chamber 330. As illustrated in FIG. 3, portions of liquid-storage chamber 330 may have different elevations, for example so that liquid tends to pool at the location of intake 323. In the example of FIG. 3, liquid may be added to liquid-storage chamber 330 through fill valve 325. From the perspective of FIG. 3, when end effector 310 moves in a clockwise direction relative to actuator 305 and/or when actuator 305 moves in a counterclockwise direction relative to end effector 310 (or both), some of rollers 315 pinch flexible tubing section 322, drawing liquid through intake 323 and moving liquid through the flexible tubing and onto the outer surface (not shown) of end effector 310. In the example of FIG. 3, the liquid may flow onto the outer surface of end effector 310 through a check valve 324, which can be used to permit liquid to flow in only one direction (e.g., out of the liquid-storage chamber and onto the outer surface of end effector 310). In particular embodiments, the outer surface of end effector 310 may include a cloth or pad 321, which absorbs the output liquid to create a moist surface for cleaning. In particular embodiments, cloth or pad 321 may cover a flexible foam material, which can deform in order to evenly wipe uneven surfaces. A section of tubing or piping may run through the foam material, carrying liquid from check valve 324 to the outer surface of end effector 310.

While FIG. 3 illustrates an example pumping apparatus that includes six rollers and one flexible tubing, this disclosure contemplates that other numbers of rollers and/or tubings may be used. For example, an increased number of rollers reduces the length of enclosed tube when pumping, allowing for more precise control of fluid output. Multiple flexible tubes may be used in parallel to increase pumping volume and/or to direct liquid flow to multiple outlets. Rollers may or may not be evenly distributed around an actuator. In particular embodiments, different lines of flexible tubing may draw from different chambers, allowing more than one kind of liquid to be pumped onto a surface on an end effector. In particular embodiments, rollers may be placed along a portion of the actuator, and the rollers may or may not be evenly distributed. In particular embodiments, pumping features within an end effector may be placed in only a portion of the interior of an end effector, for example to allow wiring or other tubing to be routed through other portions of the end effector.

The pumping apparatus illustrated in the example of FIGS. 1 and 3 provides an improved mechanism over alternative approaches. For example, transmitting fluids through rotation joints around or through a motor is difficult. In addition, gaskets and seals are necessary to transmit fluids through rotation joints, and these gaskets and seals wear out under constant use, which along with the increased mechanical complexity increases the likelihood of leaks. If an end effector is disconnected, for example by replacing the end effector with another end effector, then when fluid is transmitted through a rotation joint or motor, the liquid remains in the transmission pathway even when the end effector is removed. In contrast, in the example of FIGS. 1 and 3, no fluid flows through any rotation joint; instead, all liquid remains in the end effector, which includes the liquid-storage chamber and the tubing which carries the liquid. The peristaltic pumping action is still maintained, however, by incorporating the rollers on the actuator.

As another example of the benefits provided by the examples of FIGS. 1 and 3, motors and electrical actuators can be expensive and heavy. However, as illustrated in the example apparatus of FIGS. 1 and 3, a single actuator actuates both the rotational motion of the end effector—providing the cleaning, sanding, polishing, cutting, etc. action—and also actuates peristaltic pumping action through the relative movement of the rollers and the flexible tubing. As another example, many applications require that fluid be applied in a controlled way to an outer surface of an end effector. For example, for a cleaning application, typically only 2-4 mL of liquid is retained in a damp cloth or pad. Soaking the whole cloth or pad uses excessive liquid, which can leave undesirable wet streaking on surfaces. The peristaltic pumping action actuated by actuator 305 ensures controlled, accurate distribution of liquid onto the outer surface of the end effector.

The example of FIG. 3 illustrates a liquid-intake chamber that uses gravity and changes in elevation of the chamber to move liquid to the intake of the flexible tubing. Particular embodiments may alternatively or additionally use other methods to move liquid toward the intake. For example, the liquid-storage chamber may include a bladder that inflates as it fills with liquid and then pushes liquid out of an outlet (which is placed near the tubing intake) as the bladder deflates. As another example, one or more pistons may be placed in the liquid-storage chamber, and these pistons may slide through the chamber to push liquid to the tubing intake. In particular embodiments in which the rotation speed of the end effector is relatively high, the weight distribution of the end effector may be evenly distributed to keep the device balanced and prevent shaking.

In particular embodiments, an apparatus such as the example apparatus of FIG. 3 may be operated in a first direction (e.g., in which end effector 310 rotates clockwise relative to actuator 305) in order to dispense liquid onto the outer surface of the end effector, and may be operated in a second direction opposite the first direction to operate the end effector without liquid flow, for example because a check valve only permits liquid to flow in one direction. In particular embodiments, an end effector may have multiple liquid-storage tanks, tubes, and check valves, such that operation in one direction dispenses fluid from one chamber and operation in a second direction dispenses fluid from another chamber.

In particular embodiments, a check valve may be switchable to enable the device to run in both pumping (i.e., dispensing liquid) and intake (i.e., drawing in liquid) modes. For example, a check valve may have a first position that permits liquid to flow out through the check valve onto the outer surface of the end effector. When the check valve is in the first position, liquid is dispensed when the apparatus is operated with rotation in a first direction, and liquid is neither dispensed nor drawn in when the device is operated with rotation in the second direction. For example, a cleaning robot may operate the end effector with rotation in the first direction to dispense cleaning solution onto a cleaning pad of the end effector. The cleaning robot may operate the end effector with rotation in the second direction, for example to scrub or wipe a surface via the end effector, without dispensing liquid onto the outer surface, for example in order to avoid oversaturating the cleaning pad. When the liquid-storage chamber of the end effector needs to be refilled, the check valve can be set to a second position which only permits liquid to flow in the opposite direction as when the check valve is set to the first position. In this operation, the outlet of the fluid pathway becomes the inlet, and liquid (or air) may be drawn through the inlet into the liquid-storage chamber. When the check valve is set to the second position, the outlet can be submerged into new cleaning solution and operated in the second direction, causing liquid to be drawn into the liquid-storage chamber. The check valve may then be set to the first position, and cleaning operation of the robot may be resumed.

In particular embodiments, a check valve may be manually switched between two settings. In particular embodiments, a check valve may be automatically switched between two settings, for example based on a liquid level, a moisture level, a current use of the end effector, or any suitable combination thereof.

In particular embodiments, any suitable approach may be used to track remaining liquid volume in a liquid storage chamber. For example, tracking remaining liquid volume may be performed by integrating actuator motion, which determines how much liquid is removed from the chamber. A flow sensor or a liquid-level monitor may alternatively or additionally be used to monitor the amount of liquid in a chamber, and an alarm or notification may be used to notify a user when the liquid reaches a predetermined level.

In particular embodiments, a moisture sensor may be used to measure moisture level of the outer surface of the end effector (e.g., of a cloth or pad at the outer surface of the end effector).

Figure 4:
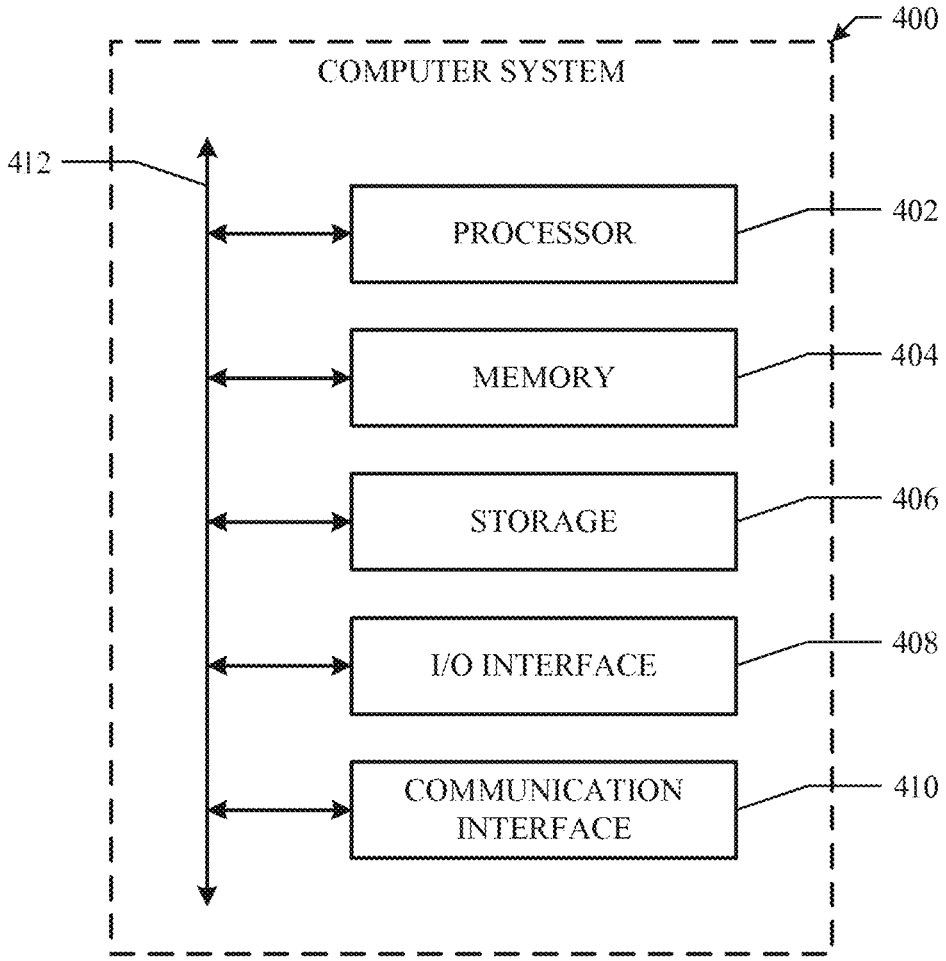
FIG. 4 illustrates an example computing system.

FIG. 4 illustrates an example computer system 400. In particular embodiments, one or more computer systems 400 perform one or more steps of one or more methods described or illustrated herein. In particular embodiments, one or more computer systems 400 provide functionality described or illustrated herein. In particular embodiments, software running on one or more computer systems 400 performs one or more steps of one or more methods described or illustrated herein or provides functionality described or illustrated herein. Particular embodiments include one or more portions of one or more computer systems 400. Herein, reference to a computer system may encompass a computing device, and vice versa, where appropriate. Moreover, reference to a computer system may encompass one or more computer systems, where appropriate.

This disclosure contemplates any suitable number of computer systems 400. This disclosure contemplates computer system 400 taking any suitable physical form. As example and not by way of limitation, computer system 400 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, or a combination of two or more of these. Where appropriate, computer system 400 may include one or more computer systems 400; be unitary or distributed; span multiple locations; span multiple machines; span multiple data centers; or reside in a cloud, which may include one or more cloud components in one or more networks. Where appropriate, one or more computer systems 400 may perform without substantial spatial or temporal limitation one or more steps of one or more methods described or illustrated herein. As an example and not by way of limitation, one or more computer systems 400 may perform in real time or in batch mode one or more steps of one or more methods described or illustrated herein. One or more computer systems 400 may perform at different times or at different locations one or more steps of one or more methods described or illustrated herein, where appropriate.

In particular embodiments, computer system 400 includes a processor 402, memory 404, storage 406, an input/output (I/O) interface 408, a communication interface 410, and a bus 412. Although this disclosure describes and illustrates a particular computer system having a particular number of particular components in a particular arrangement, this disclosure contemplates any suitable computer system having any suitable number of any suitable components in any suitable arrangement.

In particular embodiments, processor 402 includes hardware for executing instructions, such as those making up a computer program. As an example and not by way of limitation, to execute instructions, processor 402 may retrieve (or fetch) the instructions from an internal register, an internal cache, memory 404, or storage 406; decode and execute them; and then write one or more results to an internal register, an internal cache, memory 404, or storage 406. In particular embodiments, processor 402 may include one or more internal caches for data, instructions, or addresses. This disclosure contemplates processor 402 including any suitable number of any suitable internal caches, where appropriate. As an example and not by way of limitation, processor 402 may include one or more instruction caches, one or more data caches, and one or more translation lookaside buffers (TLBs). Instructions in the instruction caches may be copies of instructions in memory 404 or storage 406, and the instruction caches may speed up retrieval of those instructions by processor 402. Data in the data caches may be copies of data in memory 404 or storage 406 for instructions executing at processor 402 to operate on; the results of previous instructions executed at processor 402 for access by subsequent instructions executing at processor 402 or for writing to memory 404 or storage 406; or other suitable data. The data caches may speed up read or write operations by processor 402. The TLBs may speed up virtual-address translation for processor 402. In particular embodiments, processor 402 may include one or more internal registers for data, instructions, or addresses. This disclosure contemplates processor 402 including any suitable number of any suitable internal registers, where appropriate. Where appropriate, processor 402 may include one or more arithmetic logic units (ALUs); be a multi-core processor; or include one or more processors 402. Although this disclosure describes and illustrates a particular processor, this disclosure contemplates any suitable processor.

In particular embodiments, memory 404 includes main memory for storing instructions for processor 402 to execute or data for processor 402 to operate on. As an example and not by way of limitation, computer system 400 may load instructions from storage 406 or another source (such as, for example, another computer system 400) to memory 404. Processor 402 may then load the instructions from memory 404 to an internal register or internal cache. To execute the instructions, processor 402 may retrieve the instructions from the internal register or internal cache and decode them. During or after execution of the instructions, processor 402 may write one or more results (which may be intermediate or final results) to the internal register or internal cache. Processor 402 may then write one or more of those results to memory 404. In particular embodiments, processor 402 executes only instructions in one or more internal registers or internal caches or in memory 404 (as opposed to storage 406 or elsewhere) and operates only on data in one or more internal registers or internal caches or in memory 404 (as opposed to storage 406 or elsewhere). One or more memory buses (which may each include an address bus and a data bus) may couple processor 402 to memory 404. Bus 412 may include one or more memory buses, as described below. In particular embodiments, one or more memory management units (MMUs) reside between processor 402 and memory 404 and facilitate accesses to memory 404 requested by processor 402. In particular embodiments, memory 404 includes random access memory (RAM). This RAM may be volatile memory, where appropriate Where appropriate, this RAM may be dynamic RAM (DRAM) or static RAM (SRAM). Moreover, where appropriate, this RAM may be single-ported or multi-ported RAM. This disclosure contemplates any suitable RAM. Memory 404 may include one or more memories 404, where appropriate. Although this disclosure describes and illustrates particular memory, this disclosure contemplates any suitable memory.

In particular embodiments, storage 406 includes mass storage for data or instructions. As an example and not by way of limitation, storage 406 may include a hard disk drive (HDD), a floppy disk drive, flash memory, an optical disc, a magneto-optical disc, magnetic tape, or a Universal Serial Bus (USB) drive or a combination of two or more of these. Storage 406 may include removable or non-removable (or fixed) media, where appropriate. Storage 406 may be internal or external to computer system 400, where appropriate. In particular embodiments, storage 406 is non-volatile, solid-state memory. In particular embodiments, storage 406 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 406 taking any suitable physical form. Storage 406 may include one or more storage control units facilitating communication between processor 402 and storage 406, where appropriate. Where appropriate, storage 406 may include one or more storages 406. Although this disclosure describes and illustrates particular storage, this disclosure contemplates any suitable storage.

In particular embodiments, I/O interface 408 includes hardware, software, or both, providing one or more interfaces for communication between computer system 400 and one or more I/O devices. Computer system 400 may include one or more of these I/O devices, where appropriate. One or more of these I/O devices may enable communication between a person and computer system 400. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 408 for them. Where appropriate, I/O interface 408 may include one or more device or software drivers enabling processor 402 to drive one or more of these I/O devices. I/O interface 408 may include one or more I/O interfaces 408, where appropriate. Although this disclosure describes and illustrates a particular I/O interface, this disclosure contemplates any suitable I/O interface.

In particular embodiments, communication interface 410 includes hardware, software, or both providing one or more interfaces for communication (such as, for example, packet-based communication) between computer system 400 and one or more other computer systems 400 or one or more networks. As an example and not by way of limitation, communication interface 410 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 410 for it. As an example and not by way of limitation, computer system 400 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 400 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 400 may include any suitable communication interface 410 for any of these networks, where appropriate. Communication interface 410 may include one or more communication interfaces 410, where appropriate. Although this disclosure describes and illustrates a particular communication interface, this disclosure contemplates any suitable communication interface.

In particular embodiments, bus 412 includes hardware, software, or both coupling components of computer system 400 to each other. As an example and not by way of limitation, bus 412 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 412 may include one or more buses 412, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend.

What is claimed is:

1. An apparatus comprising:

an actuator coupled to an end effector, the actuator configured to rotate the entire end effector relative to the actuator;

one or more peristaltic-pump rollers coupled to the actuator; and the end effector, comprising:

a liquid-storage chamber configured to store a liquid;

a flexible tubing comprising an intake disposed within the liquid-storage chamber, an outlet configured to dispense the liquid onto an outer surface of the end effector, and a peristaltic section configured to compress against at least one of the one or more peristaltic-pump rollers as a result of the relative rotation between the actuator and the end effector, wherein every portion of the flexible tubing is part of the end effector that rotates relative to the actuator.

2. The apparatus of claim 1, further comprising a check valve disposed between the outlet of the flexible tubing and the outer surface of the end effector.

3. The apparatus of claim 2, wherein the check valve includes:

a first setting configured to allow liquid to flow out of the flexible tubing and onto the outer surface of the end effector when the relative rotation is in a first direction; and a second setting configured to allow liquid to flow from the outer surface of the end effector into the flexible tubing when the relative rotation is in a second direction that is opposite the first direction.

4. The apparatus of claim 1, wherein the liquid storage-chamber has a varying elevation, and the intake of the flexible tubing is located in a section of the liquid-storage chamber that has a relatively lower elevation.

5. The apparatus of claim 1, wherein the liquid-storage chamber comprises one or more of a bladder or a piston.

6. The apparatus of claim 1, further comprising a plurality of flexible tubings, each configured to dispense liquid from the liquid-storage chamber onto the outer surface of the end effector, and wherein every portion of each of the plurality of flexible tubings is part of the end effector that rotates relative to the actuator.

7. The apparatus of claim 1, wherein the relative rotation comprises an oscillation.

8. The apparatus of claim 1, further comprising one or more liquid-level sensors configured to detect an amount of liquid in the liquid-storage chamber.

9. The apparatus of claim 1, further comprising one or more moisture-level sensors configured to detect an amount of moisture on the outer surface of the end effector.

10. The apparatus of claim 1, wherein the end effector comprises a terminal end of a robotic arm.

11. A method comprising:

generating, by an actuator coupled to an end effector, a relative rotation between the actuator and the entire end effector; and pumping, by one or more peristaltic-pump rollers coupled to the actuator and in response to the relative rotation, liquid from a liquid-storage chamber of the end effector onto an outer surface of the end effector, wherein the liquid is pumped through a flexible tubing of the end effector, and wherein every portion of the flexible tubing is part of the end effector that rotates relative to the actuator, the flexible tubing comprising:

an intake disposed within the liquid-storage chamber;

an outlet configured to dispense the liquid onto an outer surface of the end effector; and a peristaltic section configured to compress against at least one of the one or more peristaltic-pump rollers.

12. The method of claim 11, wherein a check valve is disposed between the outlet of the flexible tubing and the outer surface of the end effector.

13. The method of claim 12, wherein the check valve includes:

a first setting configured to allow liquid to flow out of the flexible tubing and onto the outer surface of the end effector when the relative rotation is in a first direction; and a second setting configured to allow liquid to flow from the outer surface of the end effector into the flexible tubing when the relative rotation is in a second direction that is opposite the first direction.

14. The method of claim 11, wherein the liquid storage-chamber has a varying elevation, and the intake of the flexible tubing is located in a section of the liquid-storage chamber that has a relatively lower elevation.

15. The method of claim 11, wherein the liquid-storage chamber comprises one or more of a bladder or a piston.

16. The method of claim 11, wherein the end effector comprises a plurality of flexible tubings, each configured to dispense liquid from the liquid-storage chamber onto the outer surface of the end effector, and wherein every portion of each of the plurality of flexible tubings is part of the end effector that rotates relative to the actuator.

17. The method of claim 11, wherein the relative rotation comprises an oscillation.

18. The method of claim 11, wherein the end effector comprises one or more liquid-level sensors configured to detect an amount of liquid in the liquid-storage chamber.

19. The method of claim 11, wherein the end effector comprises one or more moisture-level sensors configured to detect an amount of moisture on the outer surface of the end effector.

20. The method of claim 11, wherein the end effector comprises a terminal end of a robotic arm.

* * * * *